US007222746B2

(12) United States Patent
Eckstrum

(10) Patent No.: US 7,222,746 B2
(45) Date of Patent: May 29, 2007

(54) SODA CAN SAFETY SCREEN

(76) Inventor: Kurt Eckstrum, 630 N. Morrison, Palatine, IL (US) 60067

( * ) Notice: Subject to any disclaimer, the term of this patent is extended or adjusted under 35 U.S.C. 154(b) by 391 days.

(21) Appl. No.: 10/760,638

(22) Filed: Jan. 14, 2004

(65) Prior Publication Data

US 2005/0150895 A1 Jul. 14, 2005

(51) Int. Cl.
*B65D 1/40* (2006.01)
*B65D 3/28* (2006.01)
*B65D 25/00* (2006.01)

(52) U.S. Cl. ..... 220/730

(58) Field of Classification Search ..... 220/268, 220/716, 718, 719, 729, 730, 734, 369, 370, 220/371, 372, 731
See application file for complete search history.

(56) References Cited

U.S. PATENT DOCUMENTS 4,537,326 A * 8/1985 Morehead ..... 220/269
5,379,914 A * 1/1995 Martins ..... 220/719
5,775,534 A * 7/1998 Webb et al. ..... 220/269
5,845,801 A * 12/1998 Heitl ..... 220/269

* cited by examiner

*Primary Examiner*—Anthony D. Stashick
*Assistant Examiner*—Harry Grosso
(74) *Attorney, Agent, or Firm*—National IP Rights Center

(57) ABSTRACT

A device having a screen, like that of a strainer, used to provide protection to beverage cans internally. The safety screen is located inside the can, attached to the underside of a beverage can opening about its periphery. It is meant to protect the entry of foreign objects, such as bees or insects.

1 Claim, 4 Drawing Sheets

TOP VIEW

TOP VIEW

RIGHT VIEW

SODA CAN SAFETY SCREEN

FIELD OF THE INVENTION

The present invention is directed to a device which prevents foreign objects and most particularly stinging insects such as bees and wasps and debris from entry into a beverage can.

BACKGROUND OF THE INVENTION

Insects that bite or sting are a cause of great health concern. In fact, the American Academy of Allergy, Asthma and Immunology notes that stinging insects send 500,000 people to hospitals each year. According to Orkin Pest Control, wasps, hornets, yellow jackets and fire ants are a particular problem; hot weather encourages the growth of their colonies. Just one acre can support up to forty mature fire ant colonies, each capable of containing 500,000 or more ants.

While insect bites or stings are usually not life threatening, they can be painful, easily infected and can aggravate skin disorders or allergies. Insects are particularly attracted to sugar such as that found in soda and beer cans. It is not unusual for stinging insects to crawl into a can and to lurk there ready to sting the unsuspecting beverage drinker.

A number of patents have issued directed to can and bottle covers. U.S. Pat. No. 6,321,927 is directed towards a seal for use on a container such as a beverage or food storage container and more specifically such as a soft drink, beer, or soup can where the seal prevents contamination of the rim or lip, through and area adjacent to and surrounding the drinking aperture as well as between the drinking aperture and the nearest rim. The seal covers the inner surface of the rim but does not restrict use of 6-pack rings or the like, nor does the seal interfere with stacking of the cans. The seal further includes a peel tab.

U.S. Pat. No. 5,722,561 is directed towards a pressurized can for beverage having a small opening in its lid which is sealed with a patch on the inside of the lid and which is adapted to receive a drink straw removably attached to the outside of the can.

U.S. Pat. No. 5,984,135 is directed to a beverage container cover for preventing the introduction of any contaminants into a beverage container. The beverage container cover includes a sealing layer including a top side and a bottom side, a straw extending on either side of the sealing layer and able to prevent a contaminant from passing therethrough and an adhesive substance extending about a periphery of the bottom side of the sealing layer for forming a seal with a rim of the container. A lip extends about a periphery of the top side for engaging the rim of the container and strengthening the seal therebetween. The cover further includes a first protective layer removably connected to the top side and covering a top portion of the straw and a second protective layer removably connected to the bottom side and covering the bottom side, a bottom portion of the straw and the adhesive substance. The straw may be extended whereby it extends to a base of the container.

U.S. Pat. No. 5,779,086 is directed towards a twist-off can end assembly that has a cylindrical can body and a lid assembly. The lid assembly includes a joined lid and collar. When an open end of the can body is closed by the lid assembly, a sealing lip on the collar engages a flange on the can body to form a hermetic seal. An annular chamber adjacent the sealing lip is formed by the collar and flange.

When pressure of the contents within the can body increase to a predetermined amount, gas escapes from the can interior to the annular chamber. When pressure within this annular chamber increases, the lip deforms to increase the seal between the lid assembly and can body. Therefore, a self-sealing can arrangement is obtained. The lid assembly can be readily unscrewed from the can body.

U.S. Pat. No. 4,705,186 is directed to a can end assembly formed from interconnected elements of a cover portion, a tear-shaped seal member and a pull member. This assembly encloses an end of a container, such as a beverage can. The cover portion has a dispensing opening and vent and a pivotable connection to one end of the seal member. The other end of the seal member is pivotably connected to the pull member. In a first position, the seal member will close the opening and will be beneath the pull member. Upon a slight lifting of the pull member, a seal between the seal member and opening will be broken. Continued movement of the pull member causes the seal member to rotate 180 degrees about its connection to the cover portion. During this movement, the pull member also rotates 180 degrees about its longitudinal axis and is displaced about 90 degrees relative to its initial orientation. This movement results in the seal member being positioned above the pull member and in these two elements being in an open, out of the way location to permit a consumer to empty the container. This movement may be reversed to temporarily reseal the container. In the open position, the seal and pull members may be temporarily locked beneath a flange partially surrounding the cover portion. A score line is provided beneath the cover portion to accommodate compression forces. A groove extends around the periphery of the cover portion to permit the can end assembly to snap onto the can body.

U.S. Pat. No. 5,285,924, to Morris, has an issue date of Feb. 15, 1994. The patent is directed to a plastic slidable removable cover for a beverage container, such as a soda can, that can cover or expose the can opening using the same hand that grasps the container. The cover comprises a tab portion that fits under the rivet of a conventional soda can pull ring and covers the opening created, a periphery engaging portion that grips the lip of the can, and a plurality of serrations facilitating easy sliding of the cover around the lip periphery. The cover can be easily removed for use with other containers.

Each of the above inventions deal, in varying ways, with the problem associated with protecting or covering beverages. All are expensive or require complicated extra parts. None of the patents are specifically directed to the preventing stinging insects from entering a pull-tab can.

It would be desirable to provide a simple built-in mechanism associated with a beverage can which could prevent a stinging insect from crawling into a beverage can.

It would be desirable to provide a beverage can in which a concave or expandable screen would cover over the opening and which prevents insects and impurities from entering the can.

It is an object of the present invention to provide a built-in screen mechanism which would prevent insects and other foreign objects from climbing into a beverage can such as for beer or soda.

SUMMARY OF THE INVENTION

The present invention is an internally mounted safety screen for a pull tab aluminum beverage can of the type used to hold soft drinks and beer. The screen is attached to the underside of a beverage can lid during the manufacturing process and covers the opening. It will prevent the entry of foreign objects, such as bees or insects which may cause serious problems, even death, if ingested.

The invention, in a most preferred embodiment comprises a screen, like that of a strainer, positioned around the interior of a flip top beverage can, the screen being affixed to the opening of the outer periphery of the opening of a can. The screen is concave so as not to obstruct the seal when it is thrust downward, positioned to prevent objects such as insects from obtaining access to the can.

In an alternative preferred embodiment, the invention comprises an expandable screen which is designed to expand downward into the can as the can seal is opened. In this manner the screen forms a concave shape as the seal is thrust downward into the can.

A BRIEF DESCRIPTION OF THE FIGURES

Figure 3A:
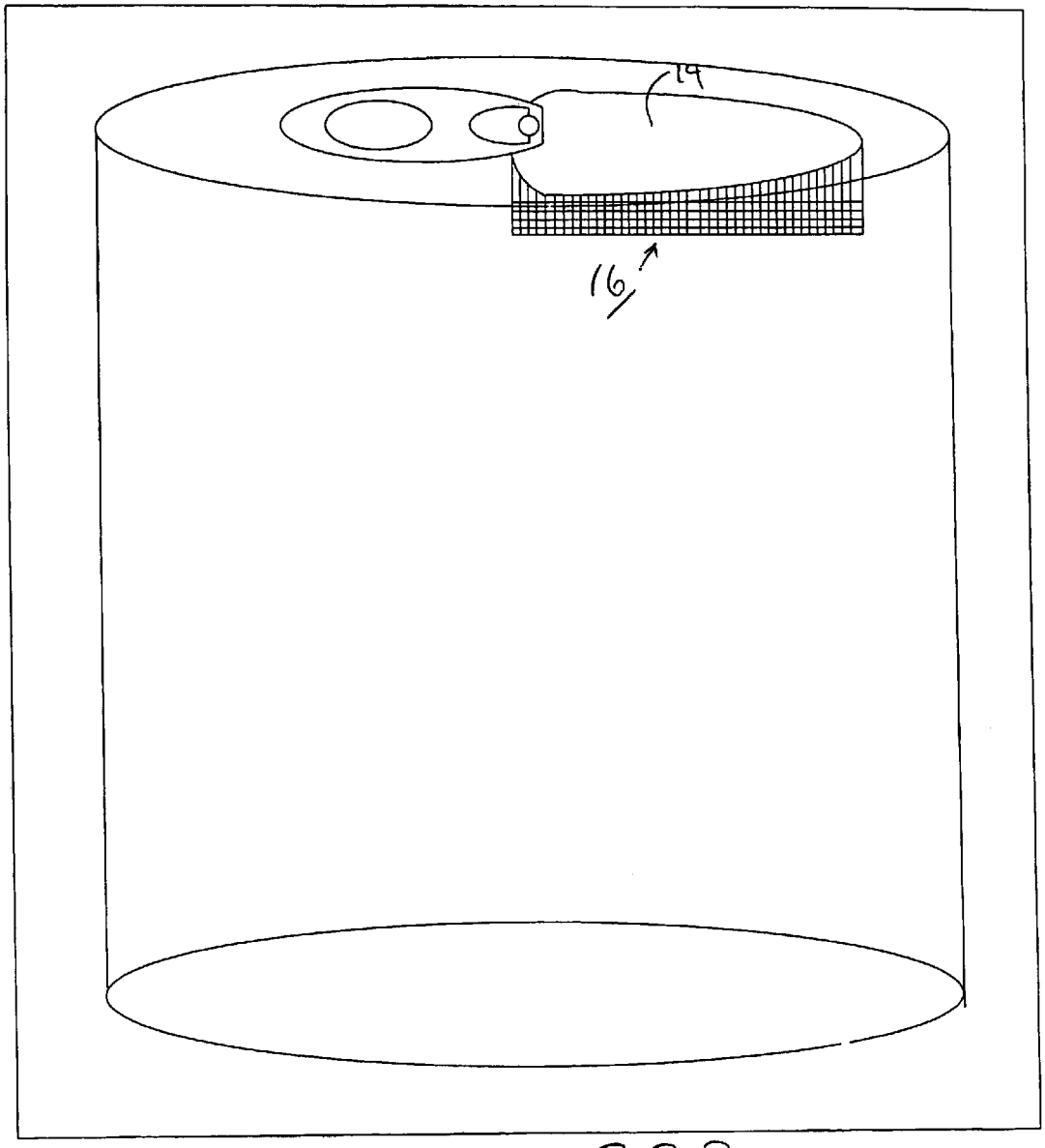
Figure 3B:
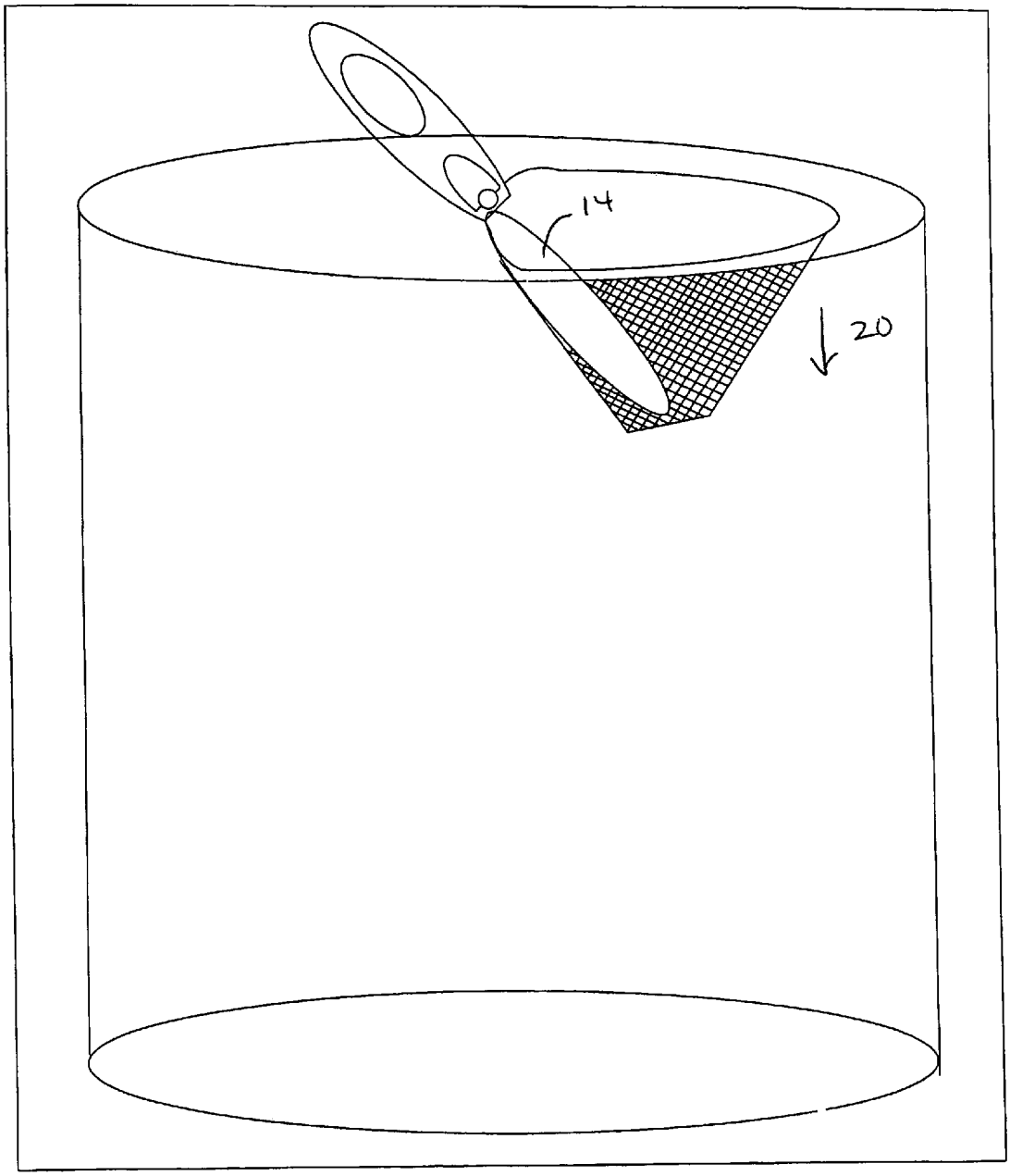

FIGS. 3*a* and 3*b* illustrate the alternative embodiment of the present invention.

DETAILED DESCRIPTION OF THE PRESENT INVENTION

The present invention is described with reference to the enclosed figures wherein the same numbers are utilized where applicable.

Figure 1:
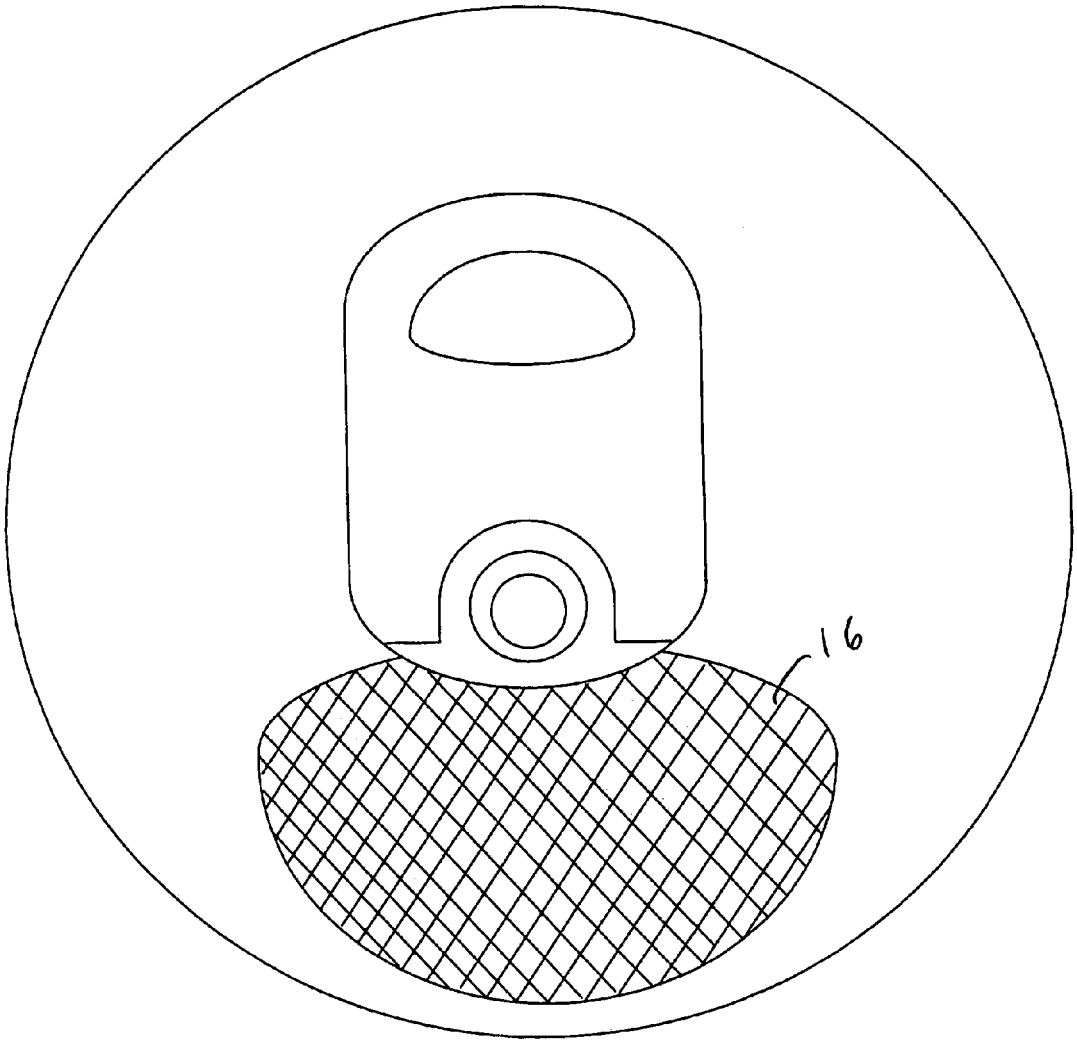
FIG. 1 is an overhead view of the present invention.

FIG. 1 is a perspective view of the invention. The present invention is designed to operate in conjunction with a standard pull top can. As can be seen, the invention comprises a conventional beverage can top with a flip top opening mechanism and sealed notch. The opening mechanism is of the type shown and described in U.S. Pat. No. 4,832,641 which comprises a top part 12 which is lifted up A and which pushes down on an ovalar shaped sealing member 14 surrounding an orifice 19 which is thrust downward to open the container. The invention, in the most preferred embodiment comprises a screen 16 designed to surround the interior orifice 19 of the can and form a complete barrier. As shown, the screen is a metallic cross mesh 16*a*. It is to be appreciated that other screen or straining mechanisms fulfill the spirit and scope of the invention. The screen may comprise a strainer of any type and may be constructed of a number of materials including polymers.

Figure 2:
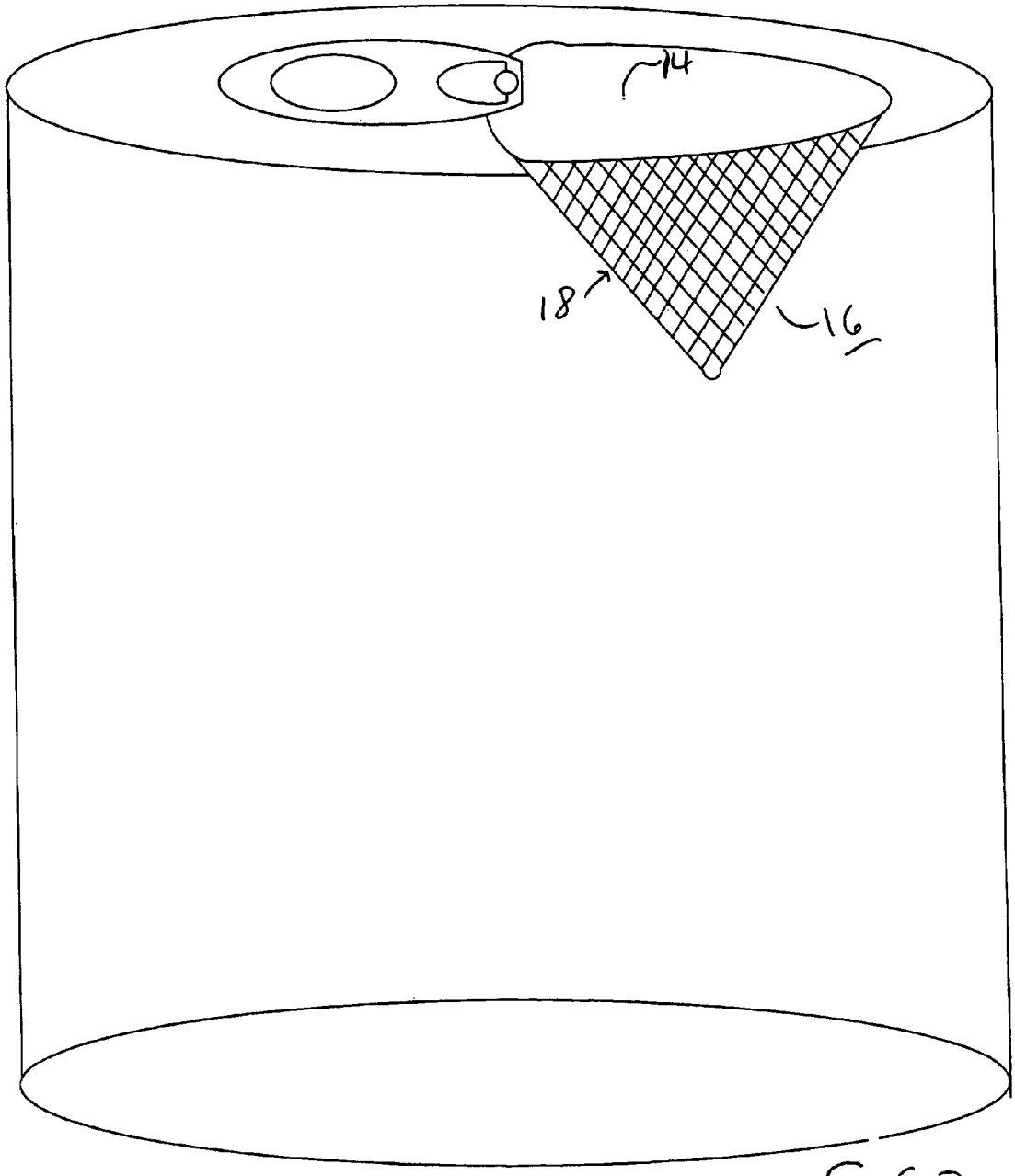
FIG. 2 is a side perspective view of the present invention.

In the preferred embodiment shown in FIG. 2, the invention is an integrated screen 16 which is affixed below the sealed opening. In one embodiment, the screen 16 is preformed as a concave shape 18, which permits the sealing member 14 to be pushed downward and opened. The screen forms a complete barrier between the opening of the can and the can's interior which blocks the entry of insects, debris and the like.

In a further embodiment of FIGS. 3*a* and 3*b*, the screen member 16 is originally flush against the opening and is expandable downward 20 as the sealing member 14 is thrust downward. Hence, the screen member 16 has an expandable feature to form the concave shape which enables the screen member 16 to expand as the sealing member 14 is thrust inward. In both embodiments, the screen member functions to prevent impurities and to stop insects from entering the can.

The present invention has been described with reference to the enclosed Figures and preferred embodiment. It is to be appreciated that other embodiments fulfill the spirit.

The invention claimed is:

1. A screen for keeping an insect or other contaminant out of a pull tab beverage can comprising:

a compressed screen member affixed to the underside of the opening member of a pull tab beverage can, said screen member capable of decompressing and expanding downward into the inside of the can when downward pressure is applied to it upon opening the can so as to permit the can to be opened while protecting the contents of the can.

* * * * *